US006167596B1

(12) United States Patent
Berman

(10) Patent No.: US 6,167,596 B1
(45) Date of Patent: Jan. 2, 2001

(54) SECURED PEN AND HOLDER

(76) Inventor: James Berman, 160 E. 93rd St., New York, NY (US) 10128

( * ) Notice: Under 35 U.S.C. 154(b), the term of this patent shall be extended for 0 days.

(21) Appl. No.: 09/369,534

(22) Filed: Aug. 6, 1999

(51) Int. Cl.[7] ..... A44B 21/00; A45F 5/02; A43K 25/02; A47F 7/00

(52) U.S. Cl. ..... 24/3.13; 24/10 R; 24/11 CT; 401/88; 401/195; 211/69.5

(58) Field of Search ..... 24/3.13, 10 R, 24/11 CT, 11 F; 401/88, 195; 211/69.1, 69.5

(56) References Cited

U.S. PATENT DOCUMENTS 1,462,108 * 7/1923 Holywell ..... 211/69.1
1,511,167 * 10/1924 Jesnig ..... 211/69.1
2,853,054 * 9/1958 Rosa ..... 211/69.5
3,570,284 * 3/1971 Hendricks ..... 401/195
4,699,536 * 10/1987 Berman ..... 401/88
5,123,548 * 6/1992 Milne ..... 211/69.5
5,699,591 * 12/1997 Kane ..... 24/13.3

* cited by examiner

*Primary Examiner*—Victor N. Sakran
(74) *Attorney, Agent, or Firm*—Reed Smith LLP

(57) ABSTRACT

A pen and pen holder arrangement provides security for retaining the pen and in which no tools are required to replace a used up pen. A pen with a flexible tether that terminates in a ball is employed together with a holder that receives the ball. The holder has a base with an opening adequate to pass the ball through and a transport that rotates within the base so that the ball can be moved from an insertion state to a holding state. In the holding state, the track has a dimension that holds the ball within the holder. A rotatable base cover that rotates with the transport obscures the transport from view and has a longitudinal slot opening enlarged at one end to permit the ball to be passed into the holder and otherwise a slot to permit the tether to move with the ball into the holding state.

10 Claims, 6 Drawing Sheets

SECURED PEN AND HOLDER

BACKGROUND OF THE INVENTION

This invention relates in general to a secured pen and pen holder designed to facilitate replacement of the pen in the holder.

The utility of this invention is for places such as banks, post offices and other public locations where the pen is provided by the establishment for use by its customers.

A pen replacement procedure for a secured pen usually involves a maintenance person when the pen is to be replaced either because the pen has run out of ink or because it has been stolen.

An example of a secured pen is taught in U.S. Pat. No. 4,699,536 issued Oct. 13, 1987. This patent teaches attaching a coin-like disk to the far end of the tether that is connected to the pen. The pen holder or base includes a slot into which the disk can be placed and which serves to prevent removing the pen.

When the pen runs out, replacement requires that a tool be used. For example, shears appropriate to cut the tether may have to be employed. This means calling in maintenance personnel.

As a practical matter, in large institutional use, it is important that the secured pen be removable from the base and replaceable without requiring a tool. This permits any person to make the change. It tends to assure that when the pen has to be replaced, it will be replaced because there is no need to either find the tool or to find the person who is authorized to use the tool. By assuring the ready replacement of pens, a substantial problem of customer complaint concerning inoperative pens is avoided.

Accordingly, the primary object of this invention is to provide a pen and a pen holder which permit quick and easy replacement of the pen in the pen holder without requiring the use of a tool to either remove the pen from the pen holder or to attach the pen to the pen holder.

BRIEF DESCRIPTION OF THE INVENTION

In brief, one embodiment of this invention employs an affixed base having a cylindrical sidewall. Inside the base is a rotatable transport disk having a recess in the wall. It is called a transport herein because of its function, which is best understood in connection with the rest of the mechanism of the pen holder. A cylindrical cover fits over the base. It covers the base and also covers the transport.

A pen assembly has a pen body to which is attached a flexible tether. The far end of the flexible tether has a bulbous ball like element which performs the function of a stop when the pen assembly is received in the pen holder.

An important relationship is that between a circular opening in the sidewall of the base cover, a comparable circular opening in the base and the above mentioned recess in the transport. When these two openings and the recess are placed in radial alignment, the pen holder is in the state to have the pen assembly either removed or inserted.

Adjacent to the opening in the base is a circumferential slot having a height great enough to accommodate the tether and small enough to prevent the stop at the end of the tether from being pulled through the slot. When the pen assembly is being coupled to the pen holder, the stop at the end of the tether is inserted through the hole in the base cover and through the hole in the base and into the recess in the transport.

A rotatable knob extends through a top opening in the base cover and into the transport to engage the transport.

Knob rotation causes the transport to rotate relative to the stationary base.

When the stop is received in the recess of the transport and the transport rotates, this rotation causes the stop to move with the transport thereby causing the tether to abut against the wall of the opening in the cover. Accordingly, rotation of the knob causes both the transport and the cover to move relative to the base. The tether moves along the circumferential slot in the base. Rotation at a predetermined amount of, for example, 90° brings the tether and stop to a pen retention position such that pulling the pen radially outward will cause the stop to abut against the inner wall of the base and thus prevent removal.

BRIEF DESCRIPTION OF THE DRAWINGS

FIG. 3A is a vertical sectional view. FIG. 3B is a horizontal cross-sectional view along a plane through the slot 40 in the base.

DESCRIPTION OF THE PREFERRED EMBODIMENTS

Figure 1:
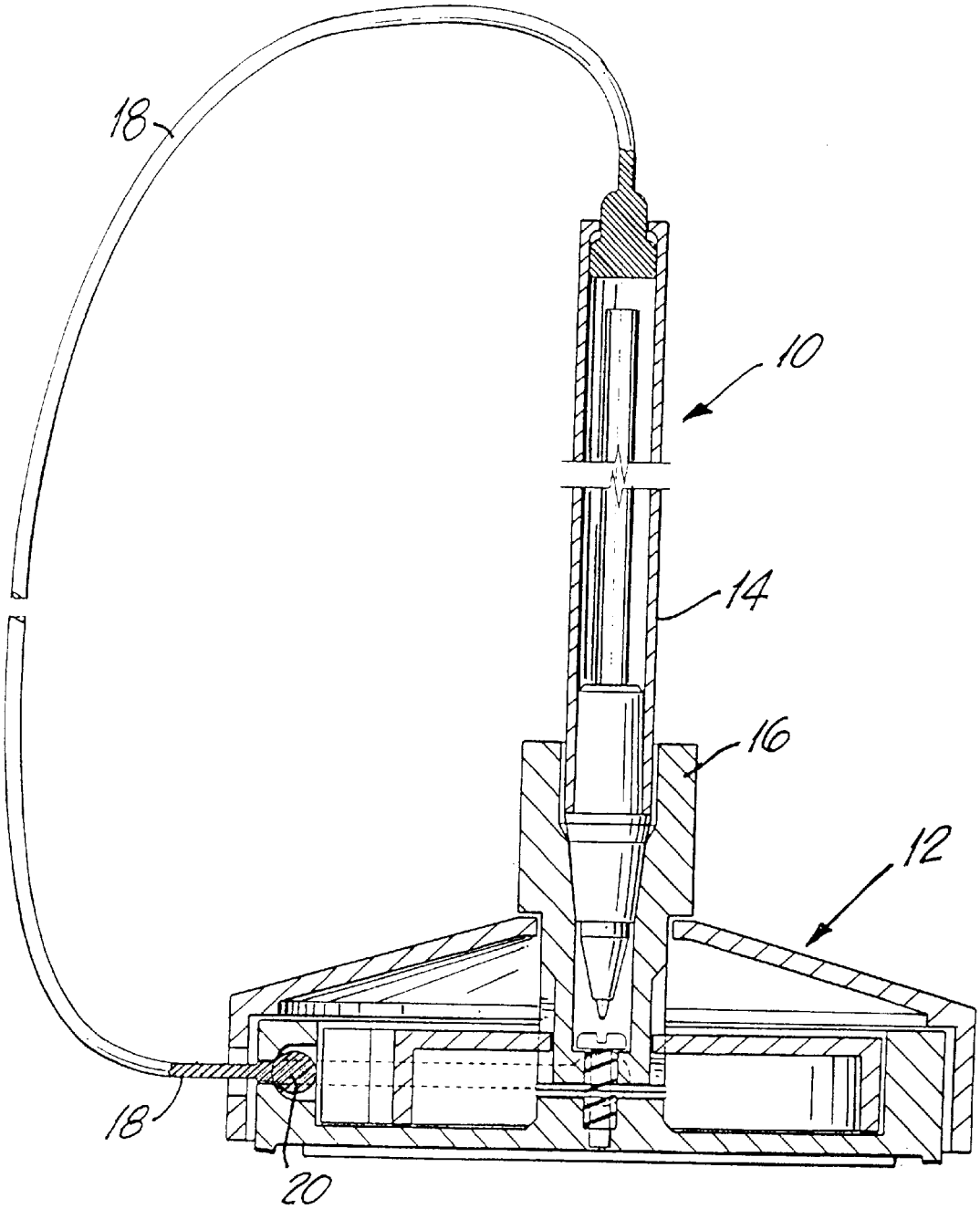
FIG. 1 is a vertical sectional view of the pen assembly 10 and pen holder 12 combination coupled together in the state wherein the pen assembly is retained in the base portion of the holder and the pen 14 is mounted in the pen receptacle 26 portion of the pen holder.

The Figs. all represent the same embodiment. There is shown a pen assembly 10 and a pen holder 12. In FIG. 1, the pen assembly 10 is shown with the pen element 14 mounted in a pen receptacle 16. A tether 18 which may be made of a molded security cable is affixed to the back end of the pen 14. The other end of the tether 18 is a ball 20 that is molded to the tether 18. As will be explained, the ball 20 operates as a stop and will be referred to herein as the stop 20.

Figure 2:
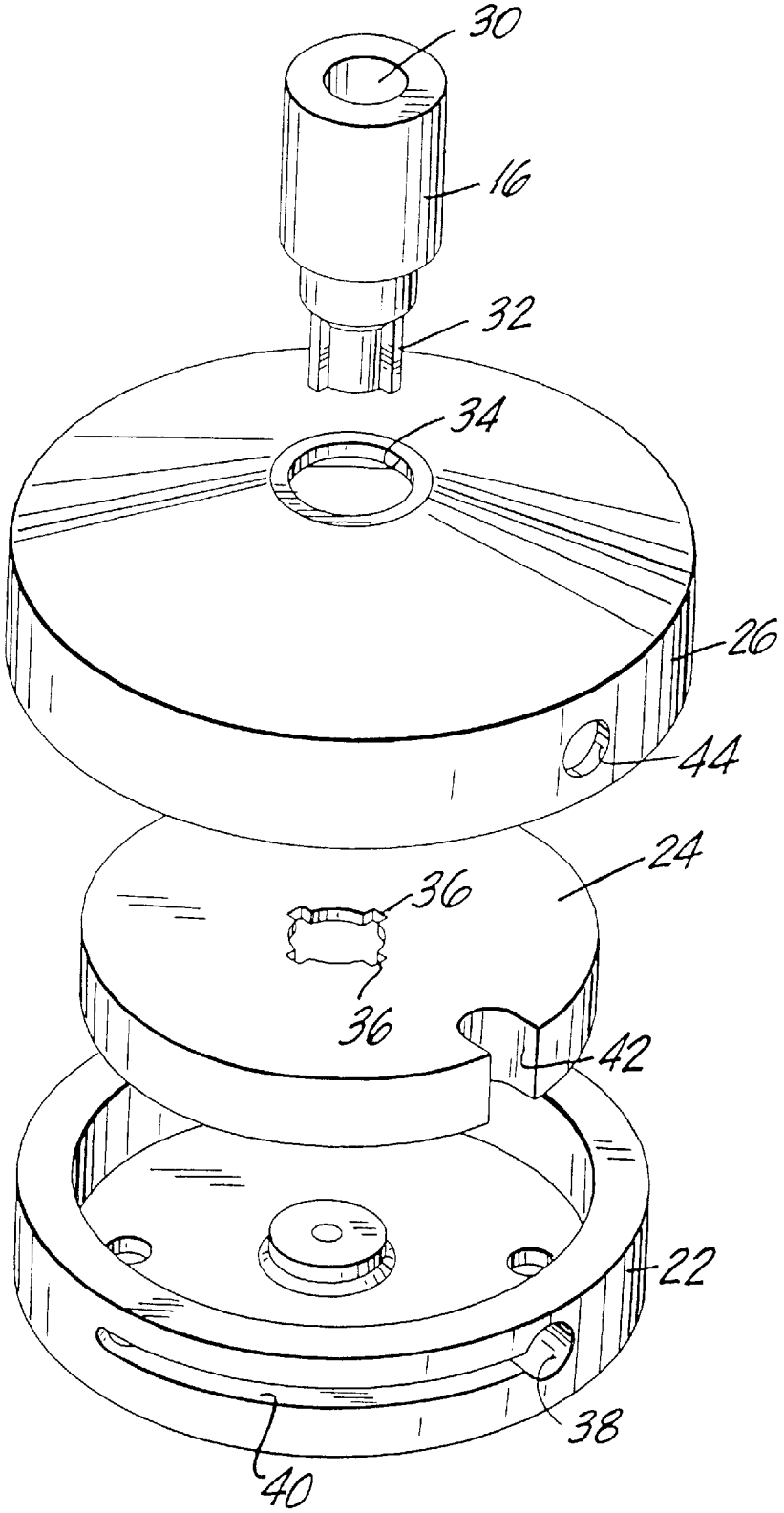
FIG. 2 is an exploded view of the main components of the pen holder; specifically the base 22, the transport 24, the base cover 26 and the pen receptacle and knob 16.

As may best be seen in FIG. 2, the main elements of the pen holder 12 is shown in exploded fashion. These elements include a base 22, a transport element 24 that fits inside the base 22 and a base cover 26 that fits over the base 22. The pen receptacle 16 has an opening 30 into which the forward end of the pen 14 can fit and be held in an upright position. The pen receptacle 16 also has a key arrangement 32. When the elements of FIG. 2 are assembled, the key arrangement 32 passes through an opening 34 in the base cover 26 and engages a mating keyway 36 in the transport element 24. The receptacle 16 also serves as a knob to permit manual rotation of the transport 24 and cover 26.

An opening 38 that extends through the sidewall of the base 22 has a diameter great enough to permit the stop 20 to pass through. A slot 40 that extends through the sidewall of the base 22 is a longitudinal slot that extends circumferentially approximately 90° around the sidewall of the base 22. The horizontal width of the slot 40 is sufficient to accommodate the diameter of the tether 18 so that the tether 18 can move along the slot but the slot 40 is small enough so that the stop 20 cannot be passed through the slot. Thus when the tether extends through the slot 40 with the stop 20 on the inboard side of the sidewall 22, the pen assembly 10 is held in the pen holder 12.

Figure 3A:
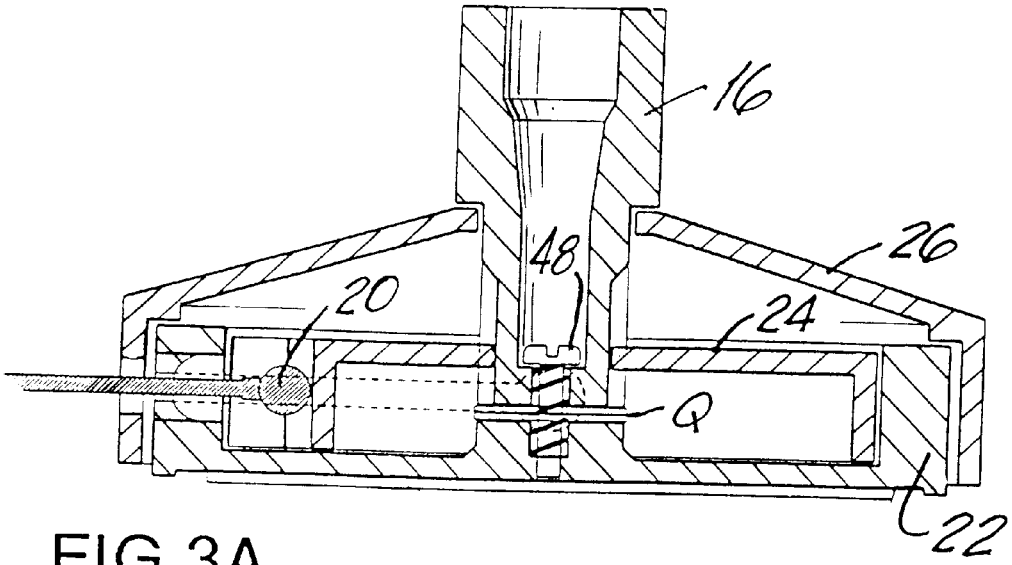
FIGS. 3A and 3B are sectional views showing the pen holder in its pen replacement state with the stop 20 at the end of the pen assembly inserted into the holder 12.
Figure 3B:
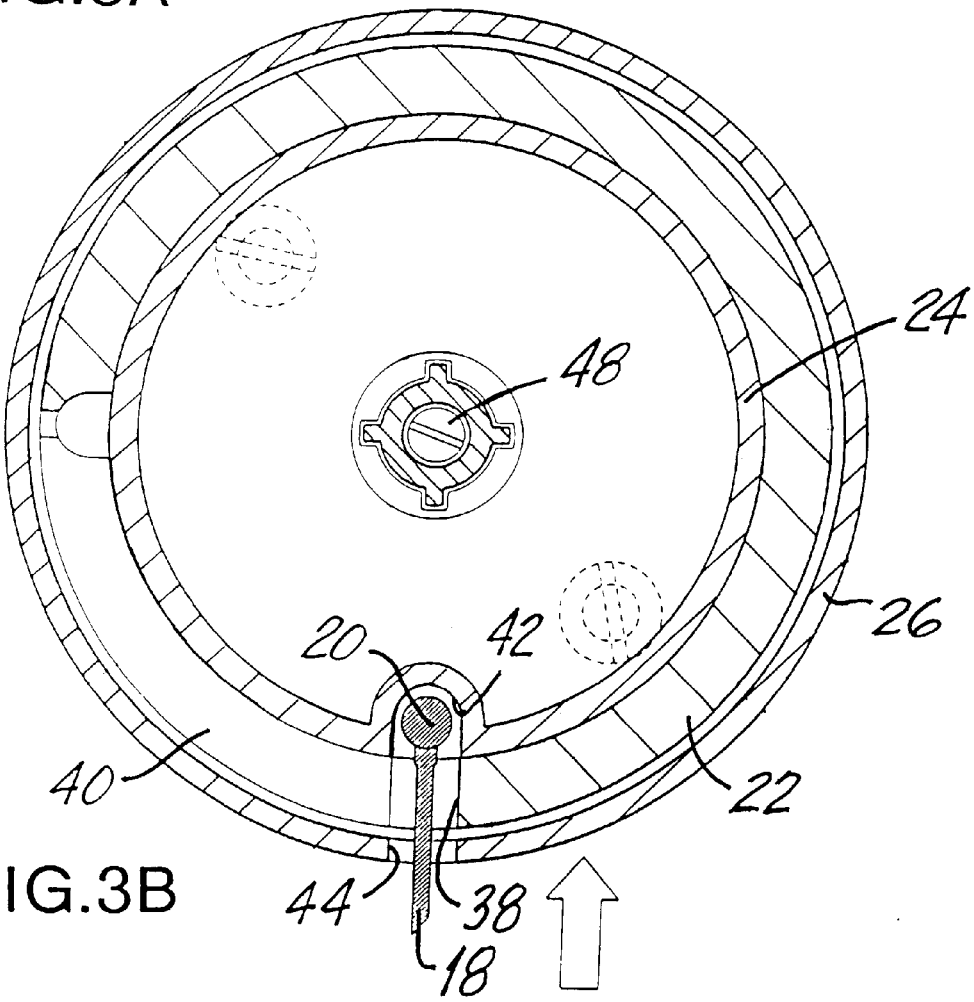

The transport 24 is formed to provide a recess 42 in its sidewall. The recess 42 is sized to accommodate the stop 20 when the stop 20 is inserted through the opening 38. The base cover 26 also has an opening 44; which opening has a diameter large enough to pass the stop 20 therethrough. When this pen holder is in its pen insertion state, as shown in FIGS. 3A and 3B, the opening 44, the opening 38 and the recess 42 are radially aligned. The pen assembly stop 20 can thus be inserted far enough into the pen holder so that the stop 20 is entirely received within the recess 42 of the transport 24.

As can be seen in FIGS. 1 and 3A, the pen receptacle 16 loosely fits within a top opening 34 of the cover 26 so that the keys 32 engage the keyways 36 in the transport 24. This assures that the transport 10 can be rotated by manual rotation of the knob like upper portion of the receptacle 16. The center screw 48 is loosely inserted so that the head of the screw 48 will prevent the recaptacle 16 from being removed. But it does not bind the the receptacle 16, so that the receptacle 16 can rotate freely about the periphery of the screw. That is, the screw theads only engage the base 22 and do not engage the receptacle 16.

When the stop 20 has been inserted fully into the recess 42 as shown in FIG. 3B, the receptacle 16 can be manually rotated thereby forcing the transport 24 to rotate. The tether 18 engages the wall of the opening 44 in the cover 26 and thus pushes the cover 26 around with the transport 24.

Figure 4:
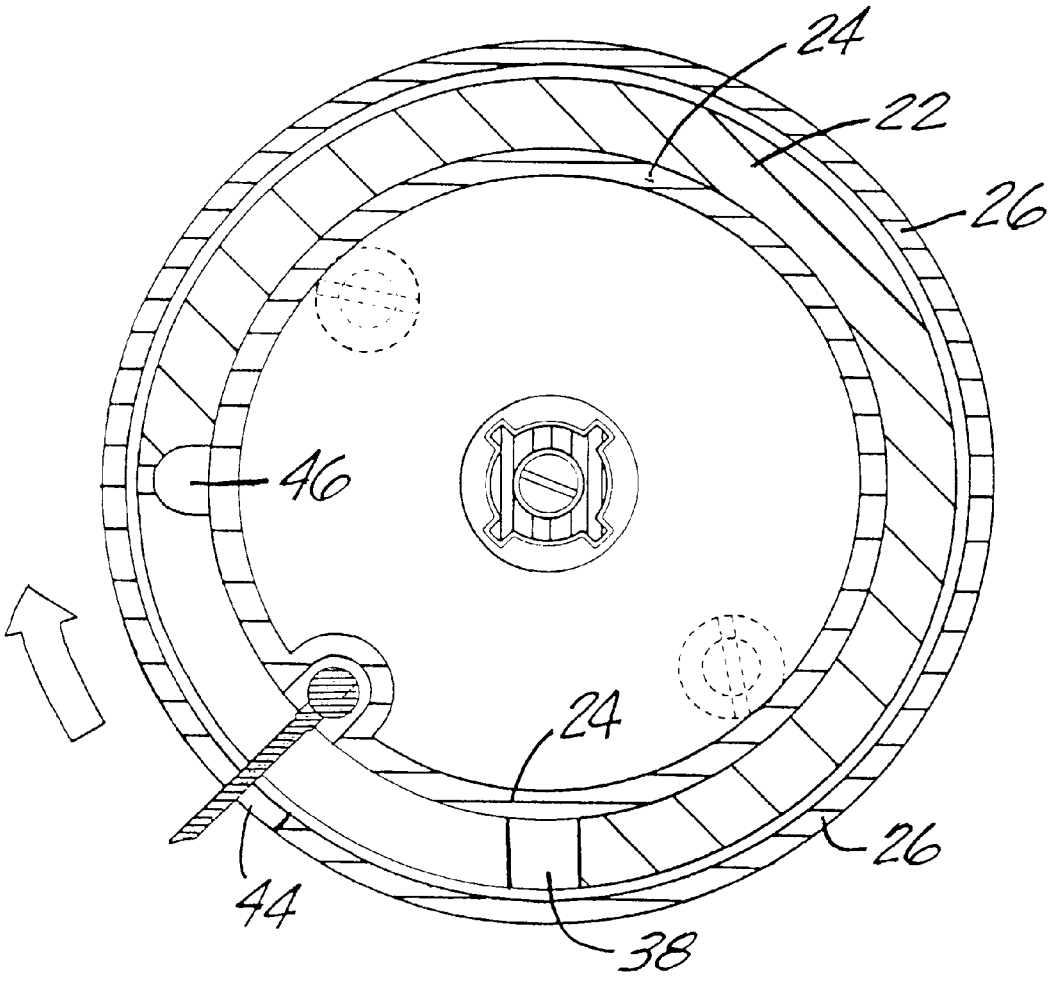
FIG. 4 is a view similar to that of FIG. 3B except that the transport 24 and base cover 26 have been rotated clockwise through an angle of about 45°. This is an intermediate state between a pen insertion state and a pen retention state.

As shown in FIG. 4, the recess 42 in the transport 24 carries the ball 20 and the associated tether 18 as the transport rotates. The tether 18 extends through the slot 40. The tether 18 contacts a wall of the opening 44 and thus pushes the cover 26 to cause the cover 26 to rotate with the transport 24.

Figure 5A:
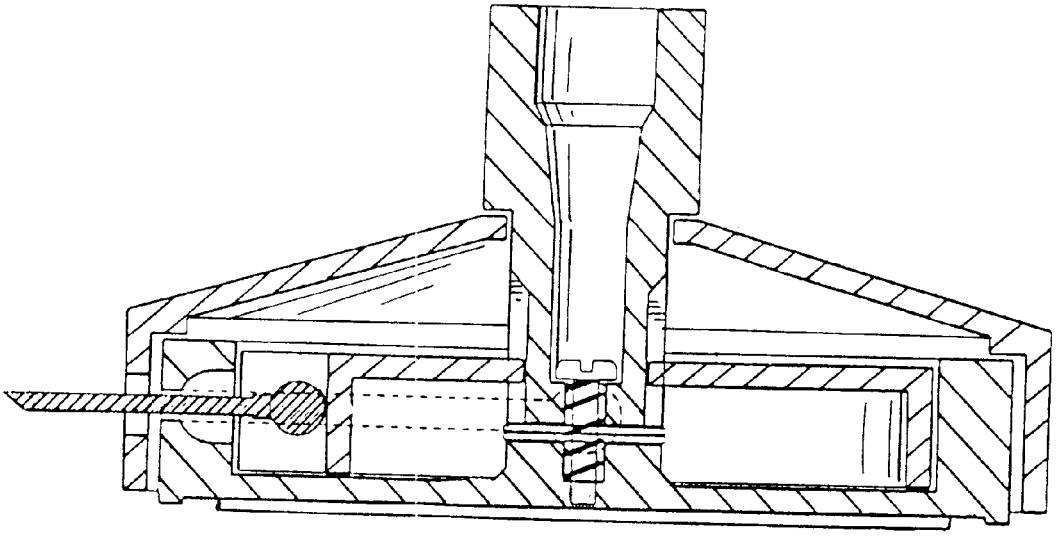
FIGS. 5A and 5B are similar to FIGS. 3A and 3B except that they show the pen retention state in which the transport 24 and base cover 26 have been rotated clockwise 90° from the pen insertion state shown in FIGS. 3A and 3B.
Figure 5B:
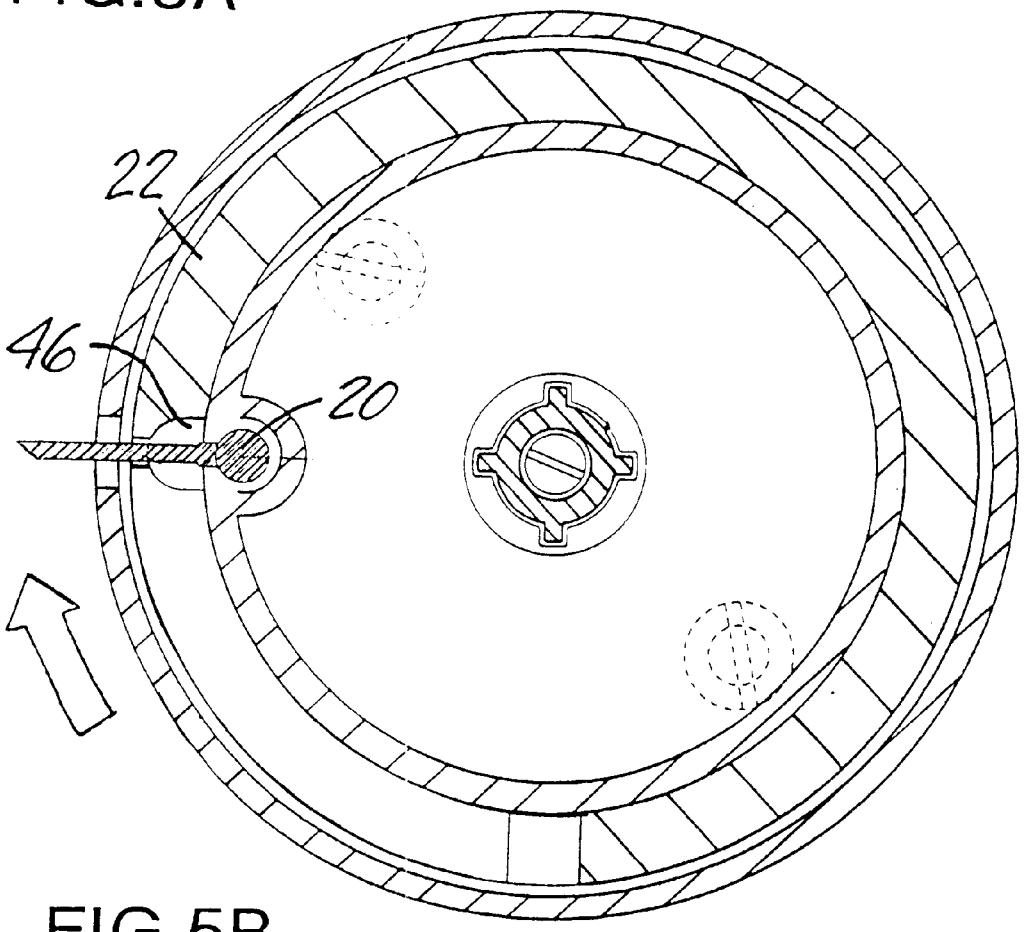
Figure 6:
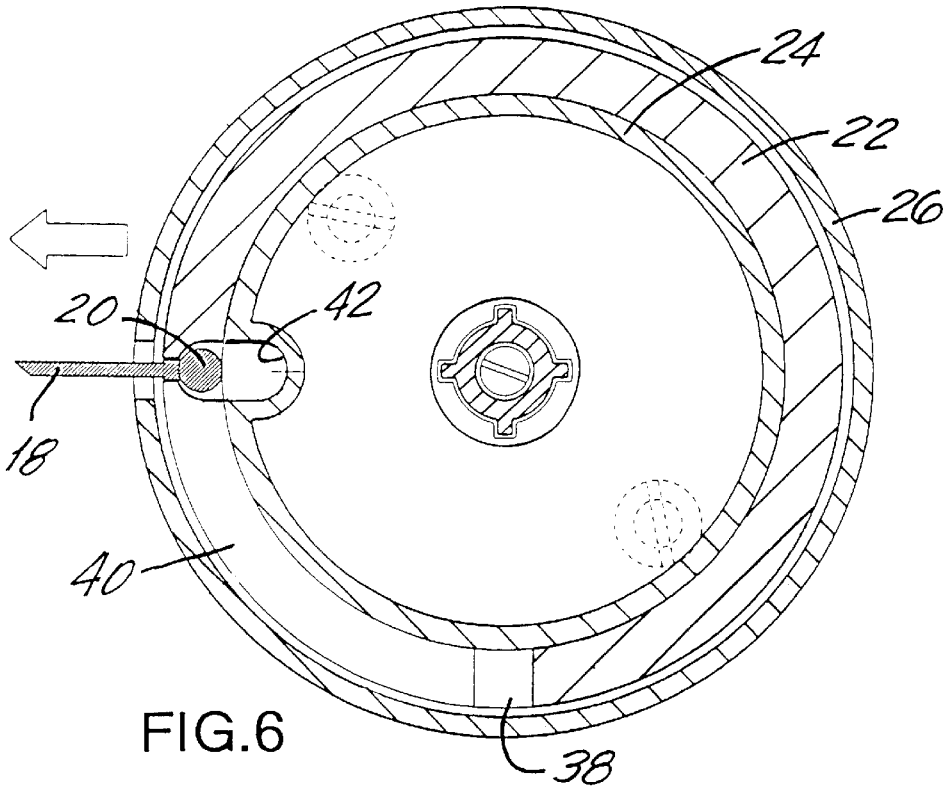
FIG. 6 is a view similar to that of FIG. 5B except that the pen assembly has been pulled radially outward so that the ball like stop 20 is received in a well 46 in the inner surface of the base sidewall.
Figure 7:
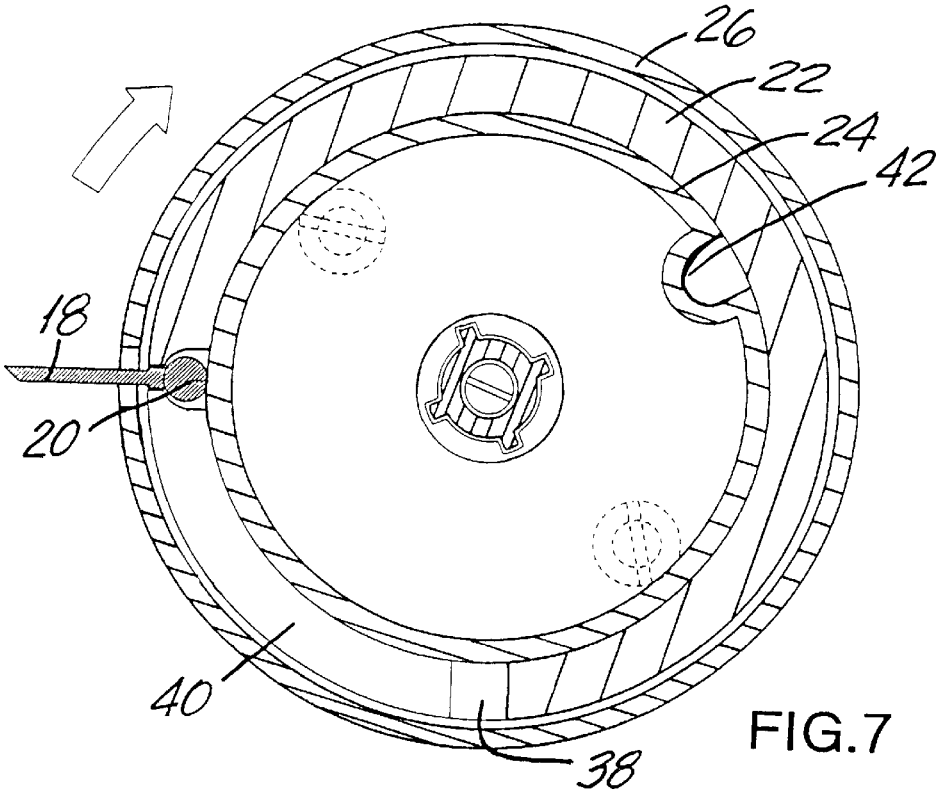
FIG. 7 is a view similar to that of FIG. 6 showing the situation where the transport 24 has been further rotated clockwise so that the recess 42 in the sidewall of the transport is no longer in communication with the opening 38 in the sidewall of the base thereby preventing the stop 20 of the pen assembly from being pushed radially inward and thus preventing circumferential movement of the tether and thus preventing manipulation of the pen assembly to provide the pen replacement state.

FIGS. 5A and 5B show the situation when the transport 24 and cover 26 have rotated 90° and the ball 20 is in radial alignment with the well 46 in the base 22. When the tether 18 and ball 20 are pulled radially outward, then as shown in FIG. 6, the ball 20 fits into the base well 46 and is entirely removed from the transport recess 42. In this condition, further rotation of the pen receptacle 16 will cause further rotation of the transport 24 to a position such as shown in FIG. 7. In this pen retention state, lateral motion of the tether 18 will not cause much movement and the holder 12 will not change state. The pen retention state will be maintained.

Only personnel who are familiar with the operation of the device would know of the need to rotate the pen receptacle 16 counter clockwise to a point where the stop 20 in the well 46 is aligned with the transport recess 42 in order for the stop 20 to be pushed radially inward into the recess 42. Further counter clockwise rotation of the receptacle 16 will result in movement into the pen assembly removal and insertion state such as shown in FIGS. 3A and 3B. In this state, the pen assembly 10 can be removed and replaced without requiring a tool. Therefore, in large scale and busy operations the likelihood of having a stolen pen promptly replaced is greatly increased.

Appropriate markers can be placed on the base cover 26 to assure that the circumferential position is obtained for movement of the stop radially between transport recess 42 and base wall 46.

What is claimed is:

1. A pen and pen holder system comprising:

a pen having a writing end and a securing end, a tether having a first end and a second end, said first end being attached to said securing end of said pen, a stop attached to said second end of said tether, said stop having a greater diameter than that of said tether, a pen holder having a base, a transport and a cover, said base having a circumferential sidewall, an elongated circumferential slot through said sidewall of said base, said slot being dimensioned to receive said tether and to hold said stop, an expanded zone at one location along said slot, said transport being shaped and dimensioned to fit within said base and to rotate around a predetermined axis relative to said base, said transport having a sidewall with a recess dimensioned to receive said stop, said recess being in communication with said slot of said base sidewall, said cover shaped and dimensioned to fit over said base and to rotate relative to said base around said axis, said cover having a sidewall with an opening therethrough, said cover opening and said expanded zone of said slot both dimensioned to receive said stop, said cover and said transport capable of rotating together relative to said base between a pen replacement state and a pen retention state, said opening of said cover, said expanded zone of said base and said recess of said transport being in alignment in said replacement state, said opening of said cover and said recess of said transport being in alignment with each other and with a portion of said slot of said base in said retention state, said pen, tether and stop being removable from and insertable into said pen holder in said replacement state, said stop being held in said recess in said retention state.

2. The system of claim 1 further comprising:

a manual operable knob extending through said base cover into engagement with said transport, rotation of said knob causing rotation of said transport and rotation of said transport when said stop is held in said recess, causing said tether to abut against a wall of said cover opening to cause said cover to rotate with said transport.

3. The system of claim 2 wherein: said manually operable knob incorporates a central opening adapted to receive the writing end of said pen.

4. The system of claim 1 wherein: said base is adapted to be fixed to a surface.

5. The system of claim 1 further comprising:

a centrally positioned pen receptacle for receiving the writing tip of the tethered pen, said cover having a surface extending across its sidewall, said surface having a central opening, said transport having a surface extending across its sidewall, said pen receptacle having a key member extending through said central opening in said cover surface and engaging said transport surface, rotation of said pen receptacle causing rotation of said transport, rotation of said transport when said stop is engaged in said recess causing said tether to abut against a wall of said opening of said cover to cause said cover to rotate with said transport between said replacement and retention states.

6. A pen holder adapted to hold a tethered pen having a stop at the end of the tether comprising:

a fixed base sidewall sandwiched between a cover sidewall and a transport sidewall, said cover and transport sidewall capable of rotating relative to said base sidewall between a pen replacement state and a pen retention state, a recess in said transport sidewall, an expanded zone in said base sidewall and an opening in said cover sidewall being in alignment in said replacement state, a slot in said base sidewall being in alignment with said recess and said opening when in said retention state, said recess, said expanded zone and said opening being dimensioned to receive the stop, said slot being dimensioned to receive the tether and to hold the stop.

7. The pen holder of claim 6 further comprising:

a manual operable knob extending through said base cover into engagement with said transport, rotation of said knob causing rotation of said transport and rotation of said transport when said stop is held in said recess, causing said tether to abut against a wall of said cover opening to cause said cover to rotate with said transport.

8. The pen holder of claim 7 wherein: said manually operable knob incorporates a central opening adapted to receive the writing end of said pen.

9. The pen holder of claim 6 wherein: said base is adapted to be fixed to a surface.

10. A pen assembly adapted to be used with a pen holder having a base sidewall sandwiched between a cover sidewall and a transport sidewall, the cover and transport being rotatable relative to said base between a pen replacement state and a pen retention state, a recess in the transport sidewall, an expanded zone in the base sidewall and an opening in the cover sidewall being in alignment in said replacement state, a slot in said base sidewall being in alignment with the recess and said opening when in said retention state comprising:

a pen having a writing end and a securing end, a flexible tether having a first end connected to said securing end of said pen and having a distal end, a stop attached to said distal end of said tether, said stop being dimensioned to be received in said transport sidewall recess, and in said base sidewall expanded zone and in said cover sidewall opening, said stop being dimensioned to be held against outward movement by said slot in said base.

* * * * *